US010823376B1

(12) United States Patent
Wang

(10) Patent No.: US 10,823,376 B1
(45) Date of Patent: Nov. 3, 2020

(54) STRING LIGHTS WITH PLUG-IN LAMP HOLDER STRUCTURE

(71) Applicant: Jianguo Wang, Guangdong (CN)

(72) Inventor: Jianguo Wang, Guangdong (CN)

( * ) Notice: Subject to any disclaimer, the term of this patent is extended or adjusted under 35 U.S.C. 154(b) by 0 days.

(21) Appl. No.: 16/100,216

(22) Filed: Aug. 10, 2018

(51) Int. Cl.
*F21V 19/00* (2006.01)
*F21S 4/10* (2016.01)

(52) U.S. Cl.
CPC ..... *F21V 19/002* (2013.01); *F21V 19/0025* (2013.01); *F21S 4/10* (2016.01)

(58) Field of Classification Search
CPC ..... F21V 19/003–0045; F21V 19/002; F21V 19/0025; H01R 33/465; H01R 33/06
See application file for complete search history.

(56) References Cited

U.S. PATENT DOCUMENTS 4,593,958 A * 6/1986 Baba ..... H01R 33/09 439/547
5,306,173 A * 4/1994 Suzuki ..... H01R 33/465 439/336
9,876,326 B1 * 1/2018 Page ..... H01R 33/22
2014/0355277 A1 * 12/2014 Lin ..... F21V 19/0025 362/391
2017/0355304 A1 * 12/2017 Lee ..... F21V 17/00
2018/0187843 A1 * 7/2018 Wei ..... F21S 4/10

* cited by examiner

*Primary Examiner* — Gerald J Sufleta, II

(57) ABSTRACT

The present invention relates to the field of lighting lamps, in particular to a string light with a plug-in lamp holder structure. According to present invention, an illuminant and the lamp holder, as well as a lamp housing and the lamp holder are all fixed in a plug-in manner, so that the installation is convenient and fast, and the structure is simple, which is beneficial to reduce the production cost. In addition, the lamp holder which is integrally formed by injection molding has better water resistance and is convenient for automatic production and assembly.

9 Claims, 3 Drawing Sheets

STRING LIGHTS WITH PLUG-IN LAMP HOLDER STRUCTURE

BACKGROUND OF THE INVENTION

The present invention relates to the field of lighting lamps, in particular to a string light with a plug-in lamp holder structure.

String lights, usually hung on walls or sculpts to create a certain atmosphere, are widely applied to the field of decorative lighting, and the light emitted by the string lights can play a very good role in decoration and setting off.

Traditional string lights generally consist of several bulbs connected in series, and a string of tungsten lights is characterized by soft and warm light. Subsequently, LED string lights whose structure mainly consists of a lamp wire and a plurality of lamps connected below the lamp wire have also emerged. Since the LED string lights are mostly hung outdoors for use, the connection strength of various components and the convenience in installation and removal are very important. At present, the lamps generally adopt LED lamp panels as light sources, and are of a structure including a lamp holder, an LED lamp panel, a light pipe and a lampshade, wherein the lampshade is connected to the lamp holder; and the lamp holder with a specific structure is used for installing the LED lamp panel and the light pipe. The disadvantage of the existing string lights is that both the tungsten bulb and the LED bulb need to be screwed down to the lamp holder by a metal screw holder, thereby leading to high production cost and inconvenient installation and removal due to the complex structure.

BRIEF SUMMARY OF THE INVENTION

In order to solve the above problems, the present invention provides a string light with a plug-in lamp holder structure, which is convenient for installation and removal and also reduces the cost effectively.

In order to achieve the above objective, a technical solution employed in the present invention is as follows: a string light with a plug-in lamp holder structure is provided, including a plurality of light-emitting string lights connected in series or in parallel, the light-emitting string lights including lamp holders, lamp housings and illuminants, and the lamp holders being electrically connected to each other through a wire, wherein female metal jacks, having clamping bumps arranged therein, are fixedly arranged inside and in the middle of the lamp holder, and one end of the female metal jack is electrically connected to the wire; strip-shaped male metal pins, which are plugged into the female metal jacks to be clamped to the clamping bumps and electrically connected to the female metal jacks, are arranged at an upper end of the illuminant; protruding clamping portions are arranged around an upper end of the lamp housing, a receiving cavity, around the inside of which clamping strips corresponding to the clamping portions are arranged, is arranged at an inner lower end of the lamp holder, and the lamp housing is clamped to the lamp holder by the clamping portions and the clamping strips.

Further, an opening at the upper end of the lamp housing is extended to form a vertical cylindrical opening, the clamping portions are arranged on the surface of a lower end of the cylindrical opening, and each clamping portion whose cross section is an arc-shaped bump has the shape of a ring protruding in the horizontal direction, and the clamping strips are arranged upward in the receiving cavity of the lamp holder from outside to inside.

Two clamping portions are arranged on the surface of the lower end of the cylindrical opening. Two sets of clamping strips are arranged in the receiving cavity, each set having two clamping strips.

Further, the clamping portion whose cross section is an arc-shaped bump is arranged on a lower side of the opening at the upper end of the lamp housing, and there are two clamping strips oppositely arranged in the same horizontal line.

One clamping strip is arranged upward in the receiving cavity of the lamp holder from outside to inside, and the other clamping strip is arranged downward in the receiving cavity of the lamp holder from outside to inside.

Further, the illuminant is a tungsten bulb or an LED light bar.

Further, the LED light bar includes a shell, an LED filament and the male pins, the male pins being arranged at an upper end of the LED filament.

The shell is a glass shell or a colloidal shell.

The lamp holder is integrally formed by injection molding.

The beneficial effects of the present invention are as follows: According to the present invention, the female metal jacks are fixedly arranged inside and in the middle of the lamp holder of the string light, and the male metal pins on the illuminant are plugged into the female metal jacks and clamped and fixed to the clamping bumps in the female metal jacks. The upper end of the lamp housing is also directly plugged into the lower end of the lamp holder, and is clamped and fixed by the clamping portions and the clamping strips, while the upper end of the lamp housing is also directly clamped and fixed to the lower end of the lamp holder by the clamping portions and the clamping strips. According to present invention, the illuminant and the lamp holder, as well as the lamp housing and the lamp holder are all fixed in a plug-in manner, so that is the installation is convenient and fast, and the structure is simple, which is beneficial to reduce the production cost. In addition, the lamp holder which is integrally formed by injection molding has better water resistance and is convenient for automatic production and assembly.

BRIEF DESCRIPTION OF THE DRAWINGS

FIG. 3 is a structural schematic diagram of an LED light bar according to the present invention, in which:

1: Light-emitting string light; 11: Lamp holder; 111: Female metal jack; 112: Clamping bump; 12: Receiving cavity; 121: Clamping strip; 2: Lamping housing; 21: Clamping portion; 22: Cylindrical opening; 3: Illuminant; 31: Male metal pin; 32: Tungsten bulb; 33: LED light bar; 331: Shell; 4: Wire.

DETAILED DESCRIPTION OF THE INVENTION

In order to make the technical problems solved by the present invention, the technical solutions and the beneficial effects more clear, the present invention will be described in further detail below with reference to the accompanying drawings and the embodiments. It should be understood that the specific embodiments are described herein only for the purpose of explaining the present invention, and are not intended to limit the present invention.

Figure 1:
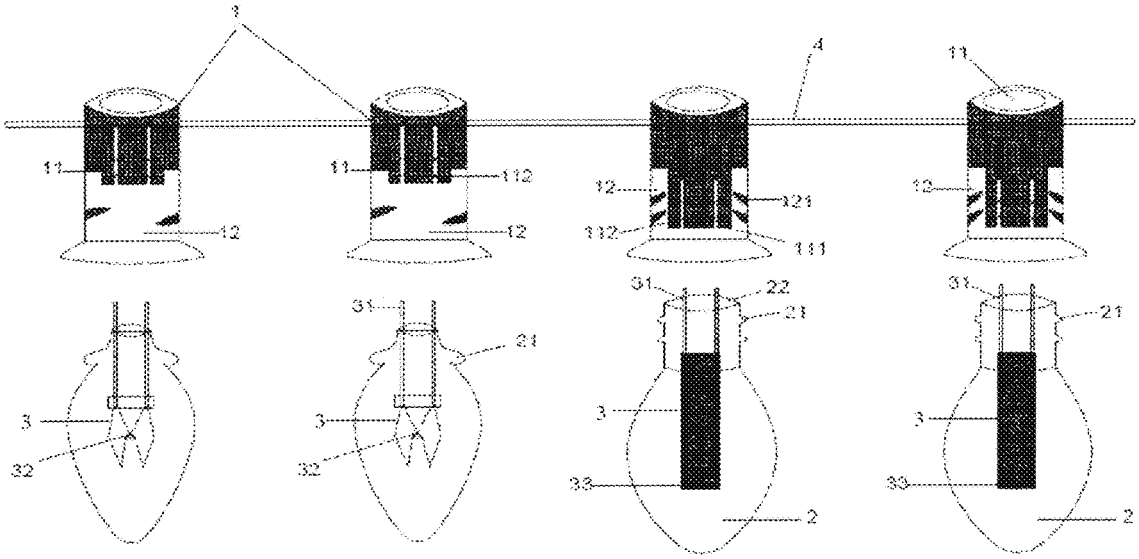
FIG. 1 is a structural schematic diagram according to the present invention.
Figure 2:
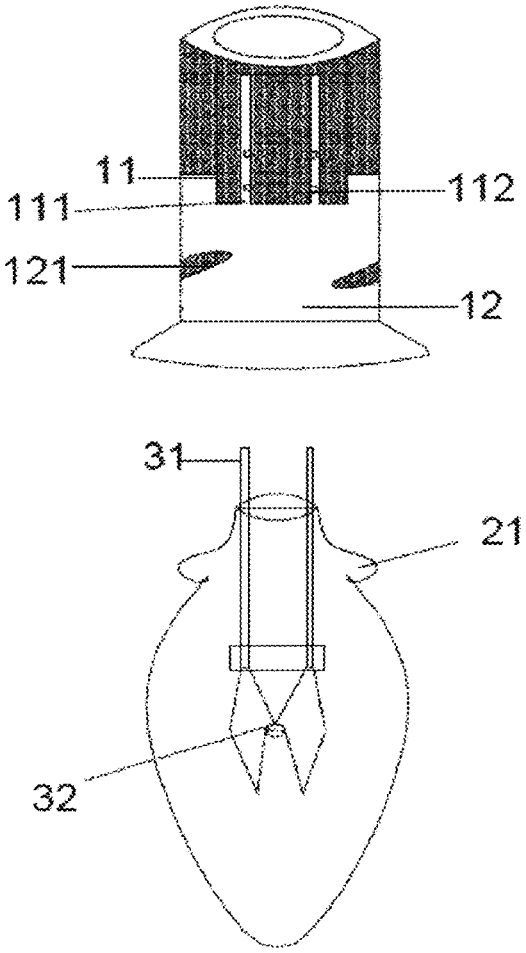
FIG. 2 is a structural schematic diagram of a tungsten bulb according to the present invention.
Figure 3:
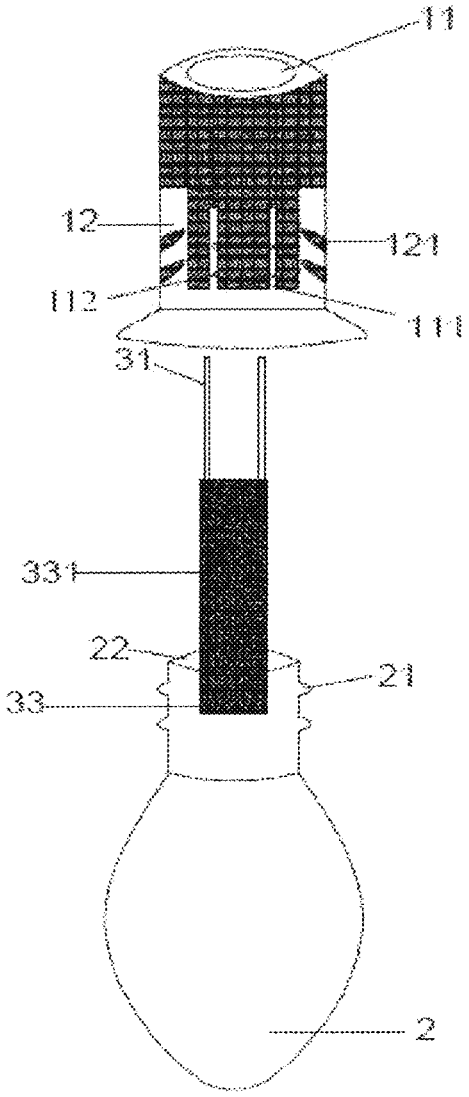

Referring to FIGS. 1 to 3, the present invention relates to a string light with a plug-in lamp holder structure, including a plurality of light-emitting string lights 1 connected in series or in parallel, the light-emitting string lights 1 including lamp holders 11, lamp housings 2 and illuminants 3, and the lamp holders 11 being electrically connected to each other through a wire 4, wherein female metal jacks 111, having clamping bumps 112 arranged therein, are fixedly arranged inside and in the middle of the lamp holder 11, and one end of the female metal jack 111 is electrically connected to the wire 4; strip-shaped male metal pins 31, which are plugged into the female metal jacks 111 to be clamped to the clamping bumps 112 and electrically connected to the female metal jacks 111, are arranged at an upper end of the illuminant 3; protruding clamping portions 21 are arranged around an upper end of the lamp housing 2, a receiving cavity 12, around the inside of which clamping strips 121 corresponding to the clamping portions 21 are arranged, is arranged at an inner lower end of the lamp holder 11, and the lamp housing 2 is clamped to the lamp holder 11 by the clamping portions 21 and the clamping strips 121.

Compared with the prior art, there is no metal screw holder which is now replaced by a male and female plug-in holder, so that operation is simple. According to the present invention, the female metal jacks 111 are fixedly arranged inside and in the middle of the lamp holder 11 of the string lights, and the male metal pins 31 on the illuminant 3 are plugged into the female metal jacks 111 and clamped and fixed to the clamping bumps 112 in the female metal jacks 111. The upper end of the lamp housing 2 is also directly plugged into the lower end of the lamp holder 11, and is clamped and fixed by the clamping portions 21 and the clamping strips 121, while the upper end of the lamp housing 2 is also directly clamped and fixed to the lower end of the lamp holder 11 by the clamping portions 21 and the clamping strips 121. According to present invention, the illuminant 3 and the lamp holder 11, as well as the lamp housing 2 and the lamp holder 11 are all fixed in a plug-in manner, so that the installation is convenient and fast, and the structure is simple, which is beneficial to reduce the production cost. In addition, the lamp holder 11 which is integrally formed by injection molding has better water resistance and is convenient for automatic production and assembly.

Further, an opening at the upper end of the lamp housing 2 is extended to form a vertical cylindrical opening 22, the clamping portions 21 are arranged on the surface of a lower end of the cylindrical opening 22, and each clamping portion 21 whose cross section is an arc-shaped bump has the shape of a ring protruding in the horizontal direction, and the clamping strips 121 are arranged upward in the receiving cavity 12 of the lamp holder 11 from outside to inside.

With the above solution, the cylindrical opening 22 at the upper end of the lamp housing 2 is partially plugged into the receiving cavity 12 of the lamp holder 11 and is clamped and fixed to the clamping strips 121, so that the installation is convenient and fast.

Two clamping portions 21 are arranged on the surface of the lower end of the cylindrical opening 22. Two sets of clamping strips 121 are arranged in the receiving cavity 12, each set having two clamping strips 121.

With the above solution, the clamping is more stable by using the two clamping portions 21, thus ensuring the firmness of connection.

Further, the clamping portions 21 also has another structure, by which the clamping portion 21 whose cross section is an arc-shaped bump is arranged downward on a lower side of the opening at the upper end of the lamp housing 2 from inside to outside, and there are two clamping strips 121 oppositely arranged in the same horizontal line. One clamping strip 121 is arranged upward in the receiving cavity 12 of the lamp holder 11 from outside to inside, and the other clamping strip 121 is arranged downward in the receiving cavity 12 of the lamp holder 11 from outside to inside.

With the above solution, the cylindrical opening 22 at the upper end of the lamp housing 2 is partially plugged into the receiving cavity 12 of the lamp holder 11 and is clamped and fixed to the clamping strips 121, so that the installation is convenient and fast. Moreover, one of the clamping strips 121 is inclined upward and the other clamping strip 121 is inclined downward so that the clamping portions 21 are clamped between the two clamping strips 121 when plugged in.

Further, the illuminant 3 is a tungsten bulb 32 or an LED light bar. The LED light bar 33 includes a shell 331, an LED filament and the male metal pins 31, wherein the male metal pins 31 are arranged at an upper end of the LED filament. The shell 331 is a glass shell 331 or a colloidal shell 331.

In this embodiment, the illuminant features two structures, one is a structure in which the common tungsten bulb 32 is directly plugged into the lamp holder 11, and the other is a structure in which the LED light bar 33 and the lamp housing 331 are directly plugged into the lamp holder 11. One or both of the two structures can be used simultaneously in the same string of lights, wherein the LED light bar 33 does not require a driving power supply, and can be normally used in case of using alternating current and direct current.

In this embodiment, the lamp holder 11 is integrally formed by injection molding, reaching the waterproof grade of IP64, which is not only good in waterproof but also convenient to assemble. In this embodiment, the LED light bar 33 can be used at a voltage of 3-260V AC or DC, and the tungsten bulb 32 and the LED light bar 33 can be used simultaneously or separately in the entire string light. In addition, the lamp housing 2 and the lamp holder 11 with two different structures of clamping portions 21 and clamping strips 121 can be alternately used in the entire string light at the same time, or the lamp housing 2 and the lamp holder 11 with one of the structures can be used separately, and there is no limitation thereto. In addition, the clamping strip 121 has elasticity and is not easily damaged during installation and removal.

The above embodiments merely describe the preferred embodiments of the present invention, and are not intended to limit the scope of the present invention. Without departing from the spirit of the present invention, various modifications and improvements made by a person of ordinary skill in the art to the technical solution of the present invention shall all fall within the protection scope defined by the claims of the present invention.

What is claimed is:

1. A string light with a plug-in lamp holder structure, comprising a plurality of light-emitting string lights connected in series or in parallel, the light-emitting string lights comprising lamp holders, lamp housings and illuminants, and the lamp holders being electrically connected to each other through a wire, wherein female metal jacks, having clamping bumps arranged therein, are fixedly arranged inside and in the middle of the lamp holder, and one end of the female metal jack is electrically connected to the wire;

strip-shaped male metal pins, which are plugged into the female metal jacks to be clamped to the clamping bumps and electrically connected to the female metal jacks, are arranged at an upper end of the illuminant; at least one protruding clamping portion is arranged around an upper end of the lamp housing, a receiving cavity, around the inside of which clamping strips corresponding to the at least one clamping portion are arranged, is arranged at an inner lower end of the lamp holder, and the lamp housing is clamped to the lamp holder by the at least one clamping portion and the clamping strips.

2. The string light with the plug-in lamp holder structure according to claim 1, wherein an opening at the upper end of the lamp housing is extended to form a vertical cylindrical opening, the at least one clamping portion is arranged on the surface of a lower end of the cylindrical opening, and each clamping portion has a cross section as an arc-shaped bump, and has the shape of a ring protruding in the horizontal direction, and the clamping strips are arranged upward in the receiving cavity of the lamp holder from outside to inside.

3. The string light with the plug-in lamp holder structure according to claim 2, wherein the at least one clamping portion comprises two clamping portions; the two clamping portions are arranged on the surface of the lower end of the cylindrical opening, and two sets of clamping strips are arranged in the receiving cavity, each set having two clamping strips.

4. The string light with the plug-in lamp holder structure according to claim 1, wherein the at least one clamping portion has a cross section as an arc-shaped bump, and is arranged on a lower side of the opening at the upper end of the lamp housing, and there are two clamping strips oppositely arranged in the same horizontal line.

5. The string light with the plug-in lamp holder structure according to claim 4, wherein one clamping strip is arranged upward in the receiving cavity of the lamp holder from outside to inside, and another clamping strip is arranged downward in the receiving cavity of the lamp holder from outside to inside.

6. The string light with the plug-in lamp holder structure according to claim 1, wherein the illuminant is a tungsten bulb or an LED light bar.

7. The string light with the plug-in lamp holder structure according to claim 1, wherein the illuminant is an LED light bar; the LED light bar comprises a shell, an LED filament and male pins, and the male pins are arranged at an upper end of the LED filament.

8. The string light with the plug-in lamp holder structure according to claim 7, wherein the shell is a glass shell or a colloidal shell.

9. The string light with the plug-in lamp holder structure according to claim 1, wherein the lamp holder is integrally formed by injection molding.

* * * * *